US005271114A

United States Patent [19]

Kjersem

[11] Patent Number: 5,271,114

[45] Date of Patent: Dec. 21, 1993

[54] SUPPORTING PILLOW

[76] Inventor: Jens A. Kjersem, Einarvikgt. 1, N-6000 Ålesund, Norway

[21] Appl. No.: 854,680

[22] PCT Filed: Nov. 1, 1990

[86] PCT No.: PCT/NO90/00166

§ 371 Date: May 4, 1992

§ 102(e) Date: May 4, 1992

[87] PCT Pub. No.: WO91/06236

PCT Pub. Date: May 16, 1991

[30] Foreign Application Priority Data

Nov. 3, 1989 [NO] Norway ..... 894375
Mar. 3, 1990 [NO] Norway ..... 901097

[51] Int. Cl.[5] ..... A47C 20/02

[52] U.S. Cl. ..... 5/640; 5/636; 5/490

[58] Field of Search ..... 5/636, 640, 643, 644, 5/645, 490

[56] References Cited

U.S. PATENT DOCUMENTS

| | | | |
|---|---|---|---|
| 1,380,480 | 6/1921 | Jennings | 5/490 |
| 1,447,288 | 3/1923 | Emmerich . | |
| 2,188,421 | 6/1940 | Wade | 5/643 |
| 2,765,480 | 10/1956 | Mueller | 5/640 |
| 3,148,389 | 9/1964 | Lustig | 5/643 |
| 3,216,028 | 11/1965 | Lawson | 5/640 |
| 3,327,330 | 6/1967 | McMullough | 5/640 |
| 3,604,026 | 9/1971 | Schelps | 5/640 |
| 3,757,364 | 9/1973 | Downing . | |
| 3,849,810 | 11/1974 | Degen . | |
| 4,754,513 | 7/1988 | Rinz . | |
| 4,853,994 | 8/1989 | Ekstein | 5/640 |
| 5,020,174 | 6/1991 | Sarkozi | 5/640 |

FOREIGN PATENT DOCUMENTS

| | | | |
|---|---|---|---|
| 1273/83 | 3/1983 | Denmark . | |
| 0363327 | 4/1990 | European Pat. Off. . | |
| 26072 | of 1909 | United Kingdom | 5/640 |

*Primary Examiner*—Peter M. Cuomo
*Assistant Examiner*—Flemming Saether
*Attorney, Agent, or Firm*—Browdy and Neimark

[57] ABSTRACT

A supporting pillow for use to support the nape of the neck/head or, if desired the small of the back when the user is at rest and/or for therapeutic treatment. The supporting pillow is formed by folding a pillow, which when folded forms an upper portion (2*a*), and a lower portion (2*b*), with lower portion (2*b*) being longer than upper portion (2*a*). Upper and lower portions are fastened to each other, preferably, with corner ends (2*a*'') of upper portion (2*a*) being fastened to the sides of lower portion (2*b*) to maintain the shape of the supporting pillow (2), thus, provided. The double portion of the supporting pillow comprising upper portion (2*a*), and lower portion (2*b*) constitutes portion (A) for the nape of the neck, and the single portion comprising the projecting lower portion (2*b*) constitutes the head portion (B) when supporting a person's nape of the neck/head. The double portion may also constitute a support of the small of the back of a person in a sitting position.

5 Claims, 2 Drawing Sheets

FIG. 1
PRIOR ART
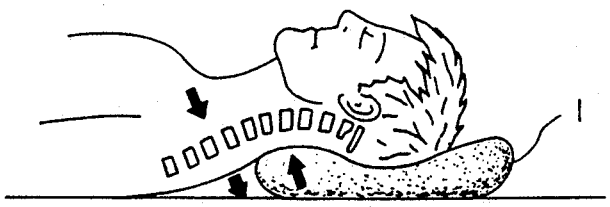
FIG. 2
PRIOR ART
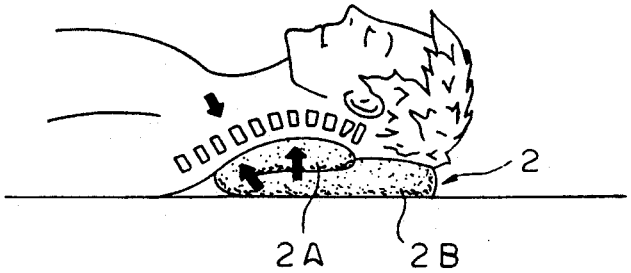
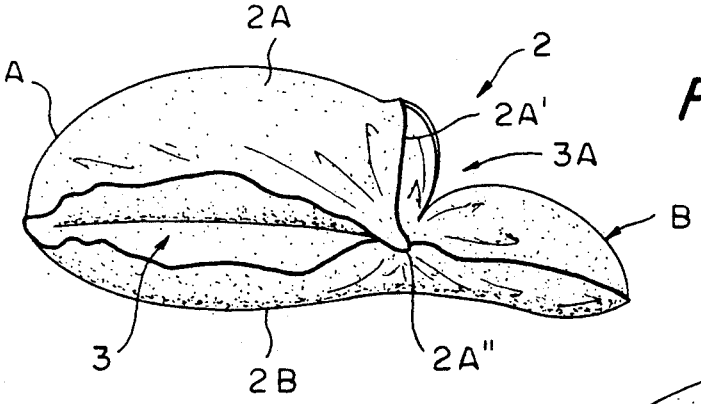
FIG. 3
FIG. 4
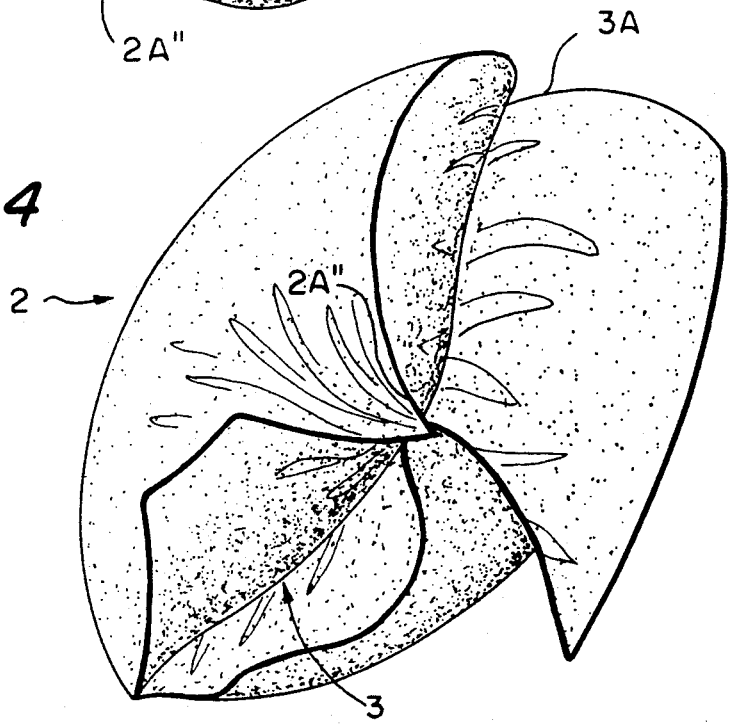

SUPPORTING PILLOW

FIELD OF THE INVENTION

The present invention relates to a supporting pillow.

BACKGROUND OF THE INVENTION

In the course of time human beings have tried lying on different supports. One problem was to place the nape of one's neck and head in a desirable manner. There may be many different manners to do that. One may try to twist one's pillow in one's sleep, bundle it up into a sphere, or fold it over, still it is very difficult to achieve a desired pillow shape. It is also possible to buy an anatomically shaped pillow.

Extreme measures also exist as regards positions of rest for a person's head or nape of the neck. An example which we may mention is a native tribe living a nomadic life in the Kalahari desert. Such a native sleeps with his head on a shoulder with the upper part of his arm serving as a supporting pillar and his elbow firmly planted in the sand. This is due to the fact that it is necessary to hold one's head above the sand to prevent small crawling animals from getting into one's ears and across one's face. They get used to this from childhood and can live with it because they lead a varied life in the daytime while they are active.

Conditions are different if someone works at an office and sits with his head and nape of the neck stooped forwards all the day and then lies with his head and the nape of his neck stooped forwards on a large pillow at night.

In a modern society of fashions and customs we get used to the present round and soft pillow from childhood. We do not enjoy this lying position as much when we sit at school all day or later, as grown-up persons with working conditions causing the normal sway-back of the nape of the neck (cervical lordosis) to be straightened. This is due to the fact that the daily strains and forms of strain change as we grow up and we feel a need for relief from special positions, even when we are asleep.

In later years pillows were manufactured which conform with the anatomic build of the nape of the neck so as to bring relief from tensions of the neck muscles. Such pillows were manufactured more or less successfully. A weakness of many of them was that they mainly supported the central portion of the back of the neck and produced a pressure forwards in order to maintain a normal lordosis of the back of the neck. When lying on one's back (supine) with gravitation acting in a downward direction, and when there is no support of any kind in the upper thoracal region, and little or no support in the region of the nape of the neck/breast-/back (cervicothoracal region) a shear force will be created in this region.

The less support there is in the lower part of nape of the neck (cervical region) and in the upper part of the thoracal region, the more shear force and negative strain there will be.

Supporting pillows of an anatomical shape were produced from more or less hard and soft materials, mainly they were moulded or cut from foamed plastic or foamed rubber. Even the softest foamed material will, due to its consistency and structure tend not to stretch and conform with the shape of the body as well as a more loosely bound material, e.g. fibres. Also, the exact anatomic shape of the supporting pillow will often only feel good during the first period of lying on it. If one wants to lie in a lateral position a pillow with an anatomic shape which is formed for lying on one's back (supine) will often be of little use.

Due to the user's need of variation of strain, as opposed to the exact anatomic shape of the supporting pillow, the user will often show a "Princess on the Pea" syndrome and many users cannot manage to use it because getting numb in the nape of the neck and the shoulders due to lack of variation.

The harder the material of the supporting pillow is—with resulting distribution of the weight of one's head and nape of the neck over a smaller support area—the higher shear force and negative strain.

Most specially shaped supporting pillows are at present relatively expensive in addition to the fact that they do not always meet the requirements to correct and varied strain.

OBJECT AND SUMMARY OF THE INVENTION

It is an object of the present invention to provide a supporting pillow which should reduce production costs as a result of very simple production. The supporting pillow should be softer and more pliable as regards the distribution of support, so that the above mentioned "Princess on the Pea" syndrome is avoided, without the pillow loosing its function as an anatomic supporting pillow. The supporting pillow should be so inexpensive that most patients are able to procure it and use it in supporting treatment. According to the invention this is achieved by the aid of the features that are stated in the characterizing part of the following independent claim 1 as well as the following dependent claims.

The supporting pillow may be manufactured in such a small and simple form that patients may take it along in a plastic bag to and from treatment. The sitting position when travelling, travelling time and economy are big problems to many patients. A long journey after treatment will be an additional strain to the patient and will often counteract the effect of treatment, and may cause longer treatment and a poorer result of treatment.

A treatment effective and inexpensive supporting pillow of the above kind may in many occasions be economically profitable to the patient in terms of shorter treatment periods and improved results.

The supporting pillow may be manufactured in various sizes, dependent on demand, mainly from a synthetic fibrous material, which will render it advantageous to allergics, but indeed, also from torn up foamed material or a down/feather material. When a new synthetic fibrous material with tube-shaped fibres is used, it will have good insulating qualities and keep warm towards the body, show specially good suppleness, but still maintain the resilient freedom of fibres to conform.

The supporting pillow is designed so as to provide a therapeutic effect in addition to its normal supporting function for one's head and nape of the neck, when a firmer insert, e.g. of foamed plastic, is provided in the formed pocket, which will enhance the lordotic pressure in the cervical region, which insert may then be removed again to re-establish the normal function of a supporting pillow. Additionally, it should be possible to use the supporting pillow to support the loins/the small of the back (lumbosacral support), e.g. as a car cushion to support and maintain a sitting person's lordosis.

In an alternative design of the supporting pillow a pillow may be maintained in a folded shape by the aid of a pillow case with an insert opening, and with fastening means being provided externally on the pillow case to maintain the folded pillow in a folded position so as to provide the above mentioned supporting pillow with a portion for the nape of the neck and a portion for the head.

BRIEF DESCRIPTION OF THE DRAWINGS

The invention will be disclosed in more detail in the following description of an embodiment of the invention with reference to the drawing, in which FIG. 1 and FIG. 2 are elevational views showing a person lying on his back with his head supported by a common pillow, and a supporting pillow according to the invention, respectively;

FIG. 3 is an elevational view of the supporting pillow in a non-loaded state;

FIG. 4 shows the supporting pillow in perspective;

DETAILED DESCRIPTION OF THE PREFERRED EMBODIMENTS OF THE INVENTION

Figure 5:
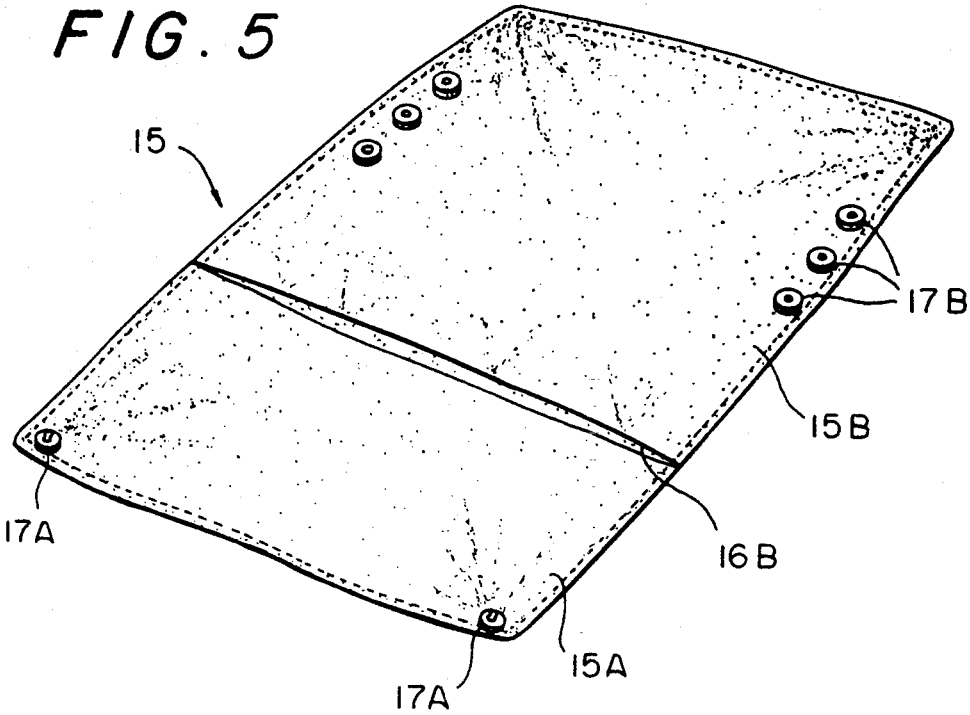
FIG. 5 shows a pillow case for the supporting pillow.
Figure 6:
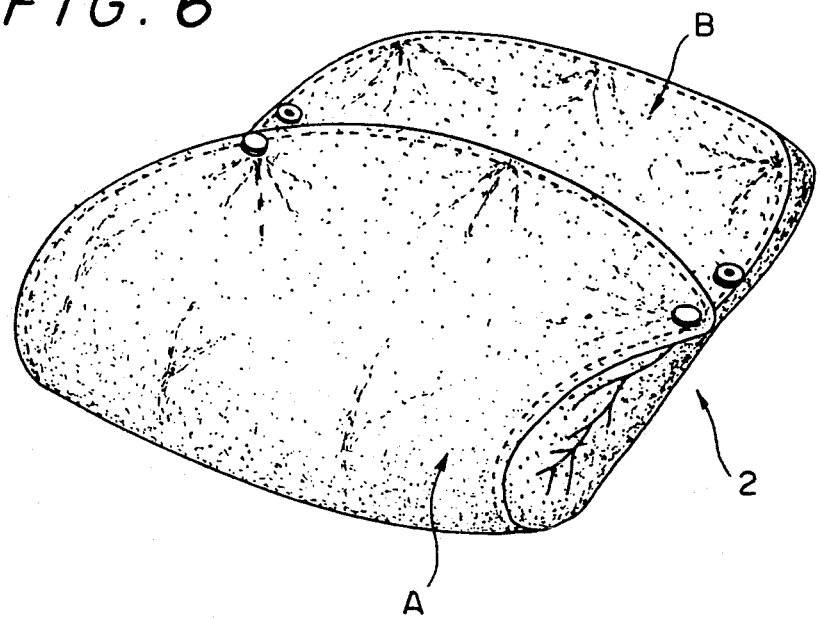
FIG. 6 shows the pillow case with a pillow, which is folded to form a supporting pillow.

By folding a rectangular pillow into an upper, and a lower portion, when using a pillow of a certain thickness, it is possible to achieve a shape which is adapted to the cervical lordotic shape of the nape of the neck. By folding the pillow into an upper portion *2a* which is shorter than the lower portion *2b*, as shown in FIG. 3, it is possible to achieve that a double portion of the supporting pillow namely thus, formed, portion A for the nape of the neck, may conform to a normal concavity of the nape of the neck whereas the user's head may rest on the single portion, head portion B, as shown in FIG. 2.

Many a person may, indeed, have folded a pillow while asleep without achieving any more successfully adapted shape than a poor anatomic shape maintained by the pressure from the user's head and nape of the neck against the pillow.

By experimentation with various manners of securing a folded fibrous pillow, it was found that by just fastening together the sides of a pillow which was folded to anatomic dimensions the ingenious result was that the formed supporting pillow had a good anatomic shape without said shape becoming so precise that it would cause the above mentioned "Princess on the Pea" syndrome. It was thus possible to lie comfortably in a lateral position.

The loose fibrous material in support pillow 2 extends down into the thoracal region and the supple tube-shaped fibres cause the supporting pillow 2 to support very well in the transitional cervicothoracal region. The shear force indicated in FIG. 1 between cervical and thoracal regions is, thus, reduced. End *2a'* of upper portion *2a* of the supporting pillow is caught by the back of the person's head when he lies on his back (supine), and is compressed so that the nape of the neck A will fill the whole cervical lordosis.

Supporting pillow 2 forms a pocket 3 between upper portion *2a* and lower portion *2b*, in which an insert of a slightly harder material, e.g. a foamed plastic, may be placed. Said insert may be varied as to thickness, so that a larger or smaller neck portion A is obtained and may, thus, be adapted to individual demands.

Pocket 3 being open, inserts may readily be replaced by thicker or thinner inserts. In this manner supporting pillow 2 may be used therapeutically for individual treatment of the nape of the neck and the back by increasing and decreasing the lordotic pressure from portion A of supporting pillow 2 at the cervical and lumbal columna, respectively, in case there is a need for that. This is an excellent supporting treatment in many kinds of physical and chiropractic treatment of the nape of the neck.

Supporting pillow 2 can commonly not be manufactured directly from common pillows which are on the market, because such pillows are slightly too thick to be doubled. By removing a little of the pillow content to make the pillow slightly thinner than common, it is however, possible to achieve a pillow which may be folded and fastened as indicated above, to provide the pillow with an optimal anatomic shape and with the properties as mentioned above so as to form a supporting pillow 2.

If end *2a'* of upper portion *2a* is not stitched together with lower portion *2b* across the latter, an open pocket 3 is achieved, and supporting pillow 2 at the same time will show good properties of anatomic adaption so that the user will lie as comfortably in a lateral position as on his back.

Supporting pillow 2 will achieve an improved ability of anatomic adaption as regards its shape if only the corner ends *2a''* of upper portion *2a* are stitched to lower portion *2b* in such a manner that the sides of pocket 3 of the supporting pillow 2 are open. This will liberate end *2a'* of upper portion *2a* still more so that it will arch out into a larger curve from one fastening point to the other. Free end *2a* is readily caught by the back of the head in the user's supine position, and it is compressed so that portion A for the nape of the neck is slightly compressed and the lordotic pressure against the cervical columna is increased. In this manner a perfect individual cervical lordosis is maintained.

The corner ends *2a''* of upper portion *2a* must be fastened, either all the way on each side to lower portion *2b*, or so much that end *2a'* of upper portion *2a* is stretched into an arch by the pillow pressure. This arch is caught by the back of the user's head and will fill the cervical lordosis when the user is supine. Said arch will provide a soft support when the user lies in a lateral position. Said arch forms the opening *3a* to pocket 3 which is formed by lower portion *2b* and upper portion *2a*, and the inner surfaces are tensioned towards one another to permit the pocket to hold on to an insert 4 which is adapted for a therapeutical condition.

What is special about supporting pillow 2 according to the invention is that it is very simple, and that by designing the supporting pillow 2 as disclosed above, a most desired product is obtained. By the aid of the invention an anatomically shaped supporting pillow 2 (a pillow for one's head and nape of the neck) is provided, which is simple in production and which provides anatomic freedom to lie supine as comfortably as in a lateral position, which creates a low shear force in the cervicothoracal region, and which may be used for a therapy/-supporting pillow for treatment in the cervicothoral and lumbosacral regions.

In order to prevent upper portion *2a* from being tensioned into an arch, especially in case of wide supporting pillows 2, e.g. 40 cm or wider, at least one rod-shaped insert made of a soft resilient material maybe inserted across the upper portion *2a*, e.g. during production of the pillow which forms the supporting pillow 2 when folded.

By providing at least one casing at the lower side of upper portion 2*a* said insert 5 or a plurality of inserts may be inserted, or removed, respectively, for adaption to the user.

The rod-shaped insert may advantageously consist of a tube-shaped resilient material, e.g. foamed plastic.

FIG. 5 shows a pillow case 15 with an insert opening 16 for a pillow. Insert opening 16 is provided across one surface of pillow case 15 in the folding area of the supporting pillow and in parallel with its folding axis to form two pockets 15*a*, 15*b* of different depths, in which the opposed portions of pillow 2 are placed. The pillow case is provided with fastening means in the shape of, e.g. snap fasteners 17, one member 17*a* of which is provided at two corners of pillow case 15 at pocket 15*a* of less depth, and the other complementary member 17*b* of which is provided in the central area of two opposite lateral edges of the deeper pocket 15*b*.

FIG. 5 shows that three snap fastener members 17*b* are arranged at a mutual distance along both opposite lateral edges of the deeper pocket 15*b* for adjustment of pillow folding and, thus, the length of upper portions 2*a* and lower portion 2*b* of the provided supporting pillow.

Said fastening means may, as mentioned above, also consist of hook and loop cloth or ribbons to be tied.

In a further alternative embodiment the supporting pillow may be designed to be an air cushion 19 provided with a valve 20, as shown in FIG. 7. Here, air cushion 19 is divided into two halves 19*a*, 19*b* comprising an air valve 20 each. The pillow is provided with a folding indication 18 which may, if desired consist of a connecting portion between both pillow members 19*a*, 19*b*. The air cushion may, obviously, be provided with only one valve 20, and an air duct between pillow members 19*a*, 19*b*, permitting both members to be supplied with air when the pillow is inflated. Air cushion 19 is folded about folding indication 18 to form a supporting pillow of the same kind as mentioned above with a portion A for the nape of the neck and a head portion B. By dividing the supporting pillow 2, if desired, into the above mentioned upper portion 2*a*, and lower portion 2*b* by the aid of a transversal seam or the like, indicating the folding area when supporting pillow 2 is to be folded into a position for use, two pillow chambers will be formed which, if desired, may be filled separately with a desired filler during production of the supporting pillow.

I claim:

1. An improved supporting pillow for use to support the nape of a neck and head of a person, said supporting pillow consisting of two pillow portions of different lengths, an integral planar transition part engaged between said two pillow portions permitting said two pillow portions to be folded upon each other to form a folded supporting pillow having a short upper portion (2*a*) and a longer lower portion (2*b*), a double portion of said folded supporting pillow (2) being formed by said short upper portion (2*a*) and said longer lower portion (2*b*), said double portion providing a portion (A) for supporting a nape of a neck while a projecting part of said lower portion (2*b*) projecting out from said double portion, provides a head portion (B) for supporting a head said supporting pillow being integrally formed and having a generally rectangular configuration and a plurality of fastening means spaced along each longitudinal side of said lower pillow portion selectively receiving mating fastening means which are positioned at corners of said upper pillow portion for maintaining a shape of said supporting pillow (2) when said two pillow portions are folded together.

2. A supporting pillow as stated in claim 1, wherein said fastening means are provided on a pillow case (15) with an insert opening (16) for a pillow.

3. A supporting pillow according to claim 2, wherein said insert opening (16) is provided across one face of pillow case (15) in said transition part of said supporting pillow, said insert opening being parallel with a folding axis of said supporting pillow, so that two pockets (15*a*, 15*b*) of different depths are formed, in which said two pillow portions of said supporting pillow are inserted.

4. A supporting pillow according to claim 3, wherein said fastening means comprises snap fasteners (17) located on the pockets.

5. A supporting pillow according to claim 1, wherein said short upper portion is approximately half the longitudinal length of said longer lower portion.

* * * * *

UNITED STATES PATENT AND TRADEMARK OFFICE

CERTIFICATE OF CORRECTION

PATENT NO. : 5,271,114

DATED : December 21, 1993

INVENTOR(S) : KJERSEM, J.A.

It is certified that error appears in the above-indentified patent and that said Letters Patent is hereby corrected as shown below:

Column 5, lines 28-41, delete the entire text starting with "In a further alternative" and ending with "the neck and a head portion B."

Signed and Sealed this

Twenty-first Day of March, 1995

*Attest:*

Bruce Lehman

BRUCE LEHMAN

*Attesting Officer*

*Commissioner of Patents and Trademarks*